United States Patent [19]

Clarke, Jr. et al.

[11] Patent Number: 4,519,729

[45] Date of Patent: May 28, 1985

[54] SEGMENTED MEMBRANE BARRIER

[75] Inventors: Robert T. Clarke, Jr., Katy, Tex.; Raymond Jasienski, Edison, N.J.

[73] Assignee: Schlegel Corporation, Rochester, N.Y.

[21] Appl. No.: 493,308

[22] Filed: May 10, 1983

[51] Int. Cl.[3] ..... E02D 5/20; E02D 29/00

[52] U.S. Cl. ..... 405/258; 405/267

[58] Field of Search ..... 405/71, 258, 267, 281, 405/109

[56] References Cited

U.S. PATENT DOCUMENTS

| | | | |
|---|---|---|---|
| 1,684,816 | 9/1928 | Arden | 405/267 |
| 3,999,392 | 12/1976 | Fukushima et al. | 405/281 |
| 4,033,137 | 5/1977 | Geist | 405/71 |

FOREIGN PATENT DOCUMENTS

| | | | |
|---|---|---|---|
| 2944385 | 5/1981 | Fed. Rep. of Germany | 405/267 |
| 49424 | 4/1980 | Japan | 405/267 |

*Primary Examiner*—David H. Corbin

*Attorney, Agent, or Firm*—Cumpston & Shaw

[57] ABSTRACT

A combination connector and supporting member for a segmented membrane barrier is disclosed. A tubular connector is joined to one end of a membrane segment along a continuous seam and a second smaller connector, adapted to fit within the tubular connector, is attached to the opposite end of the membrane segment along a second continuous seam. A projection, extending beyond the edge of the membrane segment is adapted to fit within a key or the like for supporting and locating the connectors in a trench.

14 Claims, 5 Drawing Figures

SEGMENTED MEMBRANE BARRIER

SEGMENTED MEMBRANE BARRIER

This invention relates in general to membrane fluid barriers, adapted for in-ground installation and more particularly, to a segmented membrane barrier and a unique joint construction therefor which provides both simplified joining of membrane segments and locating and supporting means for the membrane barrier during installation and in use.

As the negative affects of the uncontrolled spread of pollutants are more widely recognized, there exists an increasing need for methods and apparatus for confining potentially dangerous fluids to predefined areas. To this end, the use of impermeable membrane walls has become increasingly important. Such walls have been used heretofore in two substantially different applications, first, in the water to confine oil spills and the like as exemplified by U.S. Pat. Nos. 4,016,726; 4,033,137 and 4,084,380; or to create levies as exemplified by U.S. Pat. Nos. 3,182,459; 3,218,810 and 3,298,183; and second, buried in the ground for preventing the possible outflow of pollutants from dump sites or the like as exemplified by U.S. Pat. Nos. 4,048,710; 3,603,099 and 3,759,044. The problems involved in constructing water-borne barriers differ substantially from those involved in constructing buried barriers, and techniques useful in one application are not necessarily or obviously useful in the other.

This invention is particularly concerned with buried barriers of the type conventionally fabricated by digging a trench in the ground and placing a membrane in the trench. It has been common to fabricate such buried barriers by digging a trench and replacing the removed earth with a slurry, such as a bentonite slurry, to prevent collapsing of the trench, followed by sinking the membrane barrier in the slurry. A number of methods for submerging the barrier are known including filling an envelope, formed by folding a sheet of membrane material in two, with a material denser than the slurry so that the envelope of membrane material sinks to the bottom of the trench. While such a technique has been used with some success, more often the relatively thin (0.05–0.20 inch) membrane material wrinkles or folds during installation thus making construction of the barrier difficult. Further, it is difficult to join the end of an expired roll of membrane material to the beginning of a new roll since on-site welding is required with the free end of the expired roll still attached to the remainder of such roll already installed in the trench. Still further, it is difficult or impossible to form such a barrier having sharp angles or turns therein since the membrane material is likely to crease, fold or tear at such a small radius turn, in addition to deviating from a preferred location centered in the trench.

Accordingly, it is an object of this invention to provide a structure uniquely suited to forming buried membrane walls and particularly segmented membrane barriers for underground fluid material flow control that can be pre-fabricated in sections and readily installed without the need for on-site welding of membrane to membrane joints.

It is another object of this invention to provide a segmented membrane barrier including integral joining and supporting members for facilitating the installation of single membrane barriers.

It is another object of this invention to provide a double membrane barrier having combination joining and supporting means for both facilitating the formation of small radius turns and for increasing the integrity of the barrier, particularly at the joints thereof.

Briefly stated, and in accordance with a presently preferred embodiment of this invention, a segmented membrane barrier suitable for in-ground installation includes a membrane portion which may comprise a single or a double wall of membrane material and having cooperating end connector members at opposite ends thereof for chaining together to form a barrier of any desired length. First ones of said end members comprise tubular pipe-shaped elements having a first inside diameter and attached to one end of the membrane segment along a fluid impermeable seam. The tubular member is provided with a slot in the side wall thereof. Second end members comprise smaller tubular pipe-shaped elements adapted to fit within the first tubular member with the member extending through the slot. The space between the inner and outer tubular members is filled with an impermeable grout thereby forming a fluid impervious barrier.

In accordance with another aspect of this invention, the slot in the first member may be located either opposite the point of attachment of the membrane to the tubular member or at any desired angle with respect thereto for facilitating making small radius turns in the completed barrier construction.

While the invention itself is defined with particularity in the appended claims, the above and other objects, advantages and features of the invention will become more apparent by reference to the following detailed description thereof taken in conjunction with the accompanying drawing in which:

Figure 1:
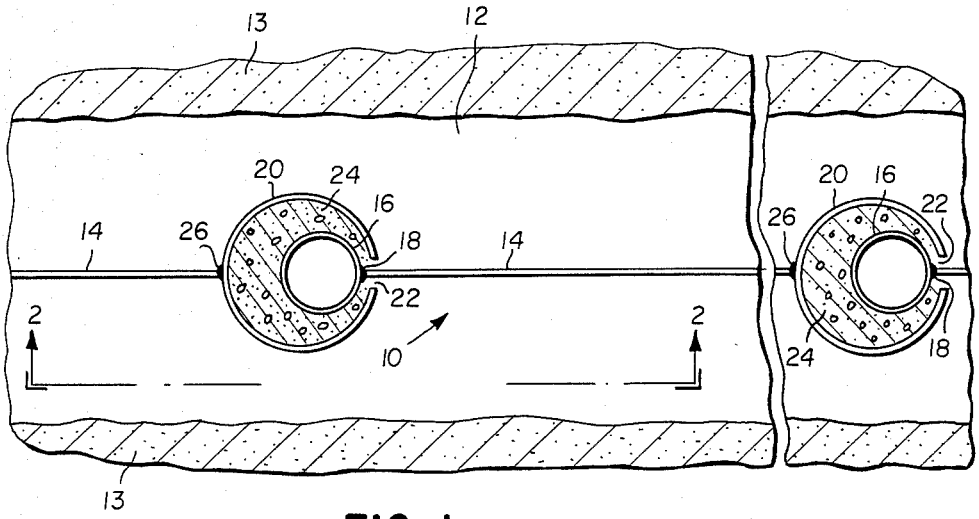
FIG. 1 is a top plan view of the joint portion of a segmented membrane wall in accordance with this invention.

Referring to FIG. 1, a membrane barrier in accordance with a presently preferred embodiment of this invention is shown in top view. Barrier 10 is disposed in an excavated trench 12 having side walls 13 and surrounding the source of pollutant and extending sufficiently deeply into the earth to prevent the out-flow of pollutants from the enclosed area. Barrier 10 may extend across the expected migration path of pollutants between natural barriers or, preferably, may completely surround a dump site or other source of pollutants.

Barrier 10 includes an impermeable relatively flexible membrane 14 that may be a rubber or plastic sheet, foil or the like, selected to be impervious to the flow of fluids therethrough. Preferably, membrane 14 is a continuous polyethylene sheet, such as SCHLEGEL sheet, available from Schlegel Lining Technology, Inc., The Woodlands, Tex. The thickness of membrane 14 is selected to provide the required mechanical strength to prevent tearing, breaking or the like for the selected span length between supports in a particular application. It has been found that thicknesses in the range of 0.050 inch to 0.400 inch are particularly usefully employed in connection with this invention with a thickness of 0.100 inches being preferred.

One end of membrane 14 is attached to a tubular connecting member 16 along continuous impermeable seam 18 and the opposite end is attached to tubular connecting member 20. Preferably, connecting member 16 is an elongated tubular member adapted to be permenantly attached to the end of membrane 14 by welding, gluing or the like. To that end, when, for example, membrane 14 is a polyethylene sheet, connector 16 is preferably a high-density polyethylene tube. While a continuous weld between compatible materials is preferred in accordance with this invention dissimilar materials may be used for connector 16 and membrane 14 and a connection therebetween may be made by fastening an L-shaped clamp or the like to connector 16 and fastening membrane 14 to the other end of the clamp. Any conventional fluid impervious sealant may be used to seal the joint between the connecting member and the clamp and the joint between the membrane and the clamp. When such a construction is employed, steel pipe, which is readily available in a variety of diameters and lengths, may readily be employed for connecting members 16 and 20 and an angle iron bracket, welded thereto by conventional techniques, used to fasten membrane 14 thereto.

The opposite end of membrane 14 is attached to connecting member 20 by any of the aforementioned methods. Connector 20 is preferably an elongated tubular member having an elongated slot-shaped opening 22 in the side wall thereof of suitable width such as 0.5 to 6 inches for passing membrane 14 therethrough while retaining connecting member 16 within connector 20. Preferably, the space between the inner surface of connector 20 and the outer surface of connector 6 is filled with an impermeable grout 24 such as concrete, cement or the like. It will be appreciated, by reference to the drawing, that a relatively long path through grout 24, at least as long as the circumference of connector 16, is formed by the interaction of connectors 16 and 20, thus even further reducing any possibility of pollutant flow past barrier 10.

Figure 2:
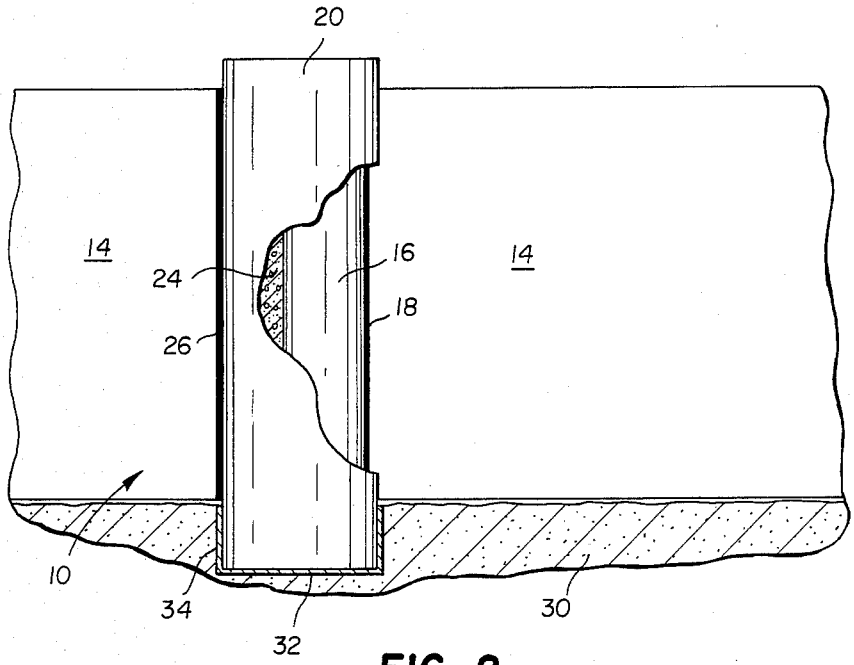
FIG. 2 is an elevational view of the embodiment of the invention shown in FIG. 1.

Referring now to FIG. 2, a side view of a portion of the barrier of FIG. 1 is illustrated. FIG. 2 illustrates only a single connection of the barrier shown in FIG. 1 and like elements are designated with like reference numerals.

A particular advantage of the construction of this invention lies in the support for membrane segments 14 provided by connectors 16 and 20. As seen in FIG. 2, a key is formed in the earthen bottom 30 of trench 12 to receive the projecting lower end of connector 20. To this end, connectors 16 and 20 are preferably longer than the height of membrane 14. An extension of 1 to 10 feet beyond the bottom edge of membrane 14 is preferred. Key 32 is preferably provided with a liner 34 which may be an inverted cap adapted to receive connector 20 and is preferably fabricated of metal, plastic or other suitable material. Key 32 both locates assembly 10 within trench 12 and prevents movement of connector 20 during installation thus facilitating the insertion of connector 16 therein. Alternatively, key 32 may be a pin, driven into the bottom 30 of trench 12 with a portion thereof extending upwardly into the trench for receiving connectors 16 and 20 thereon.

The installation of the segmented membrane barrier of FIGS. 1 and 2 commences with the excavation of trench 12. If desired, during the excavation process, trench 12 may be backfilled with a slurry to prevent collapsing of the trench and to add to the impermeability of the barrier. Bentonite is a commonly employed slurry material and may be used in connection with the barrier of this invention. After the trench has been excavated, segments of the membrane barrier of this invention may be installed. As each segment is installed, smaller connecting end portion 16 is lowered into large connector 20 with membrane portion 14 extending through slot 22. After each connection is formed, cement grout 24 may be poured into the space between connectors 16 and 20, hydraulically displacing any slurry within connector 20.

Figure 3:
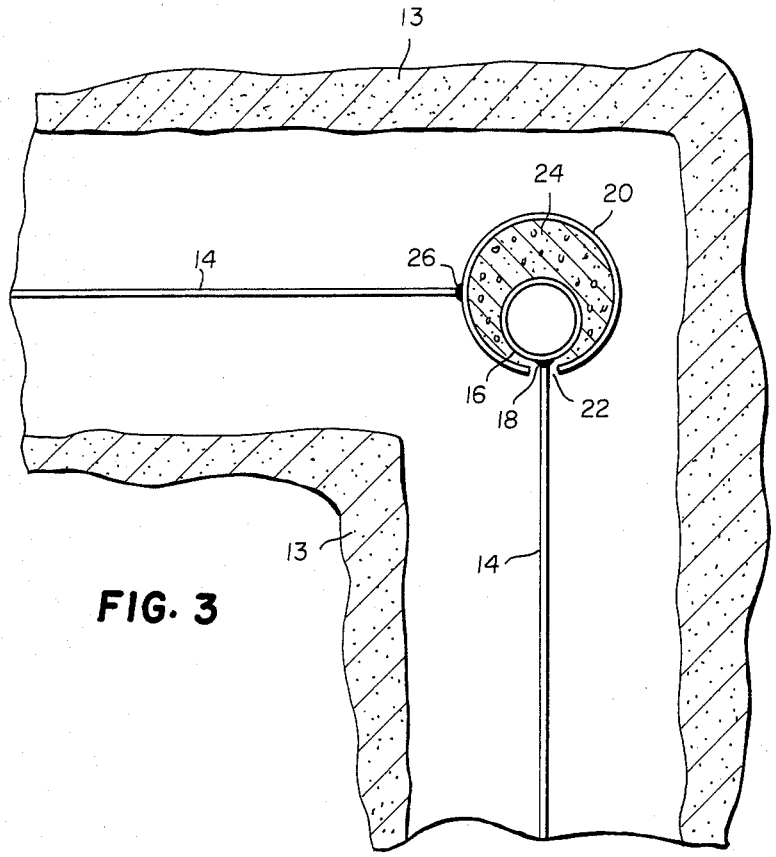
FIG. 3 is a top plan view of a right angle joint between membrane segments in accordance with this invention.

FIG. 3 shows, in top view, a right angle connection between adjacent membrane segments in accordance with a preferred embodiment of this invention. It is a particular problem in constructing continuous membrane walls that when the same are routed around corners or small radius turns in a trench, the membrane tends to deviate from its preferred position in the center of the trench, or to wrinkle or to fold over or the like. In accordance with this invention, corners of various angles may be readily implemented by locating slot 22 in connector 20 at a selected angle with respect to membrane segment 14. It is an additional advantage of this invention that further locating and supporting of the membrane segments of the barrier are provided by key 32 particularly at corners such as shown in FIG. 3.

Figure 4:
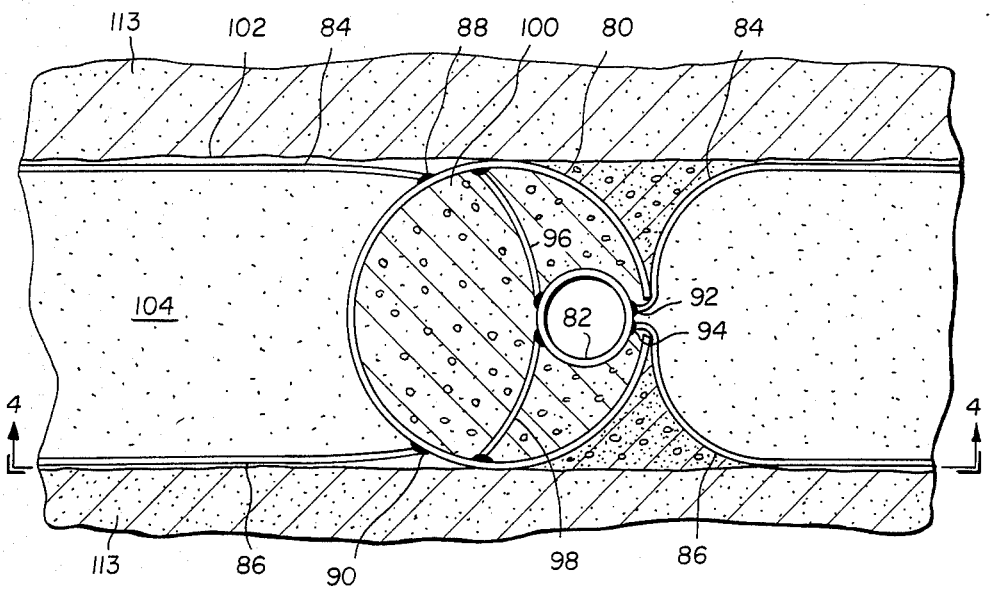
FIG. 4 is a top plan view of the embodiment of the invention having a double membrane barrier.
Figure 5:
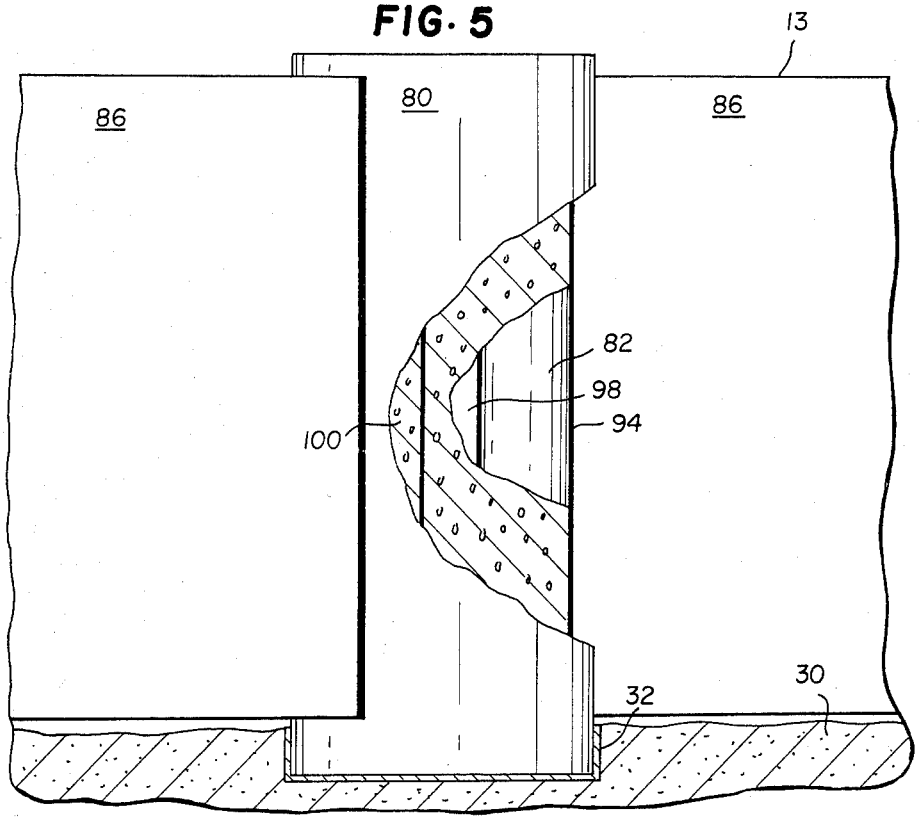
FIG. 5 is a front elevational view of the embodiment of FIG. 3.

FIGS. 4 and 5 illustrate an embodiment of this invention including two parallel membranes substantially in series across the path of pollutant flow.

Only a single intersegment connection is illustrated in FIGS. 4 and 5, it being understood that multiple connections would be provided as heretofore described in connection with the embodiment of the invention shown in FIGS. 1 and 2. A large connector 80 and a small connector 82 are attached by welding or the like, to opposite ends of each segment of the membrane barrier assembly. Two separate membrane elements 84 and 86 are attached along seams 88 and 90 respectively, to first slotted connector element 80 as has been previously discussed. Similarly, opposite ends of membranes 84 and 86 are connected along seams 92 and 94 to smaller connector element 82.

Internal membrane barriers 96 and 98 may be provided between the inner surface of connector 80 and the outer surface of connector 82 to even further reduce the flow of pollutants across the barrier. Membrane barriers 96 and 98 may be formed from segments of the same or different material as membrane segments 14. Barriers 96 and 98 may be thinner than membrane 14 for easier installation since they are substantially shorter. In addition to, or in place of, internal barriers 96 and 98, cement grout 100 is disposed between the outer wall of connector 82 and the inner wall of connector 80 to impede the flow of pollutants.

Preferably, inner barriers 96 and 98 are welded to one or the other of connectors 80 and 82 prior to assembly of the connection with the free end welded to the other connector after installation, but prior to filling with grout 100.

Preferably, trench 102 is of a width substantially equal to the diameter of larger connector 80 and seams 88 and 90 are disposed relatively close to opposite sides of connector 80 so that membranes 84 and 86 lie close to the opposing walls 113 of trench 102.

If desired, space 104 between membranes 84 and 86 can be filled with sand or water or other material to maintain membrane elements 84 and 86 closely adjacent to the outer walls of trench 102.

As seen in FIG. 5, this embodiment of the invention is also adapted to be utilized in connection with a key 32 into which connector 80 can be inserted to both support and position the end of the segment as heretofore described.

While the invention has been described in connection with certain presently preferred embodiments thereof, those skilled in the art will recognize that many modifications and changes may be made therein without parting from the true spirit and scope of the invention which is intended to be limited solely by the appended claims.

What is claimed is:

1. A membrane barrier segment for forming a buried fluid barrier comprising:

an elongate sheet of impermeable material having first and second ends;

a first one-piece tubular member connected to said first end along a first continuous seam, said first tubular member having a first outside diameter; and a second one-piece tubular member connected to said second end along a second continuous seam, said second tubular member characterized by an inner diameter greater than said first outer diameter, and having a slot in a side wall thereof for passing said continuous membrane through, at least said second tubular member having an end portion projecting beyond an edge of said sheet.

2. The barrier segment of claim 1 wherein said membrane material comprises a continuous sheet of polyethylene.

3. The barrier segment of claim 2 wherein said first and second tubular members comprise continuous high density polyethylene pipes.

4. The membrane barrier segment of claim 1 wherein said first and second continuous seams are welded seams.

5. The membrane barrier segment of claim 1 wherein said first and second continuous seams are adhesive seams.

6. The membrane barrier segment of claim 1 wherein said slot and said second continuous seam are separated by an angle less than 180°.

7. The membrane barrier segment of claim 1 further comprising an internal membrane barrier connected between said first and second tubular members.

8. A barrier for underground fluid material flow control comprising:

a trench in the earth having a length extending across the expected polution path;

a segmented membrane barrier in said trench, said barrier comprising a plurality of membrane segments;

a first tubular joining member on one end of each of said segments, each of said first joining members comprising a tubular member attached to said segment along a continuous fluid impervious seam;

said tubular members characterized by a preselected inside dimension;

a second tubular joining member on the other end of each of said segments, each of said second joining members comprising a tubular member attached to said segment along a continuous fluid impervious seam;

a slot in a side wall of each of said first tubular joining members adapted to pass said membrane therethrough when said second tubular joining elrments are disposed within said first tubular joining members; at least said first tubular joining member having an end portion projecting beyond said membrane segments;

means in said trench for receiving said projecting portion for locating and supporting said second tubular joining member;

a fluid impervious sealing material disposed in the space between said first and second tubular joining members.

9. The barrier of claim 8 wherein said membrane material comprises a continuous sheet of polyethylene.

10. The barrier of claim 8 wherein said first and second tubular members comprise continuous high density polyethylene pipes.

11. The barrier of claim 8 wherein said first and second continuous seams are welded seams.

12. The barrier of claim 8 wherein said first and second continuous seams are adhesive seams.

13. The barrier of claim 8 wherein said slot and said second continuous seam are separated by an angle less than 180°.

14. The barrier of claim 8 further comprising an internal membrane barrier connected between said first and second tubular members.

* * * * *